US007347528B2

(12) United States Patent
Van Gerven

(10) Patent No.: US 7,347,528 B2
(45) Date of Patent: Mar. 25, 2008

(54) CLEANING DEVICE FOR THE PRINTHEAD OF A PRINTER

(75) Inventor: Antonius J. J. Van Gerven, AK Grubbenvorst (NL)

(73) Assignee: OCE-Technologies B.V., Ma Venlo (NL)

( * ) Notice: Subject to any disclaimer, the term of this patent is extended or adjusted under 35 U.S.C. 154(b) by 246 days.

(21) Appl. No.: 10/769,906

(22) Filed: Feb. 3, 2004

(65) Prior Publication Data

US 2004/0155922 A1 Aug. 12, 2004

(30) Foreign Application Priority Data

Feb. 5, 2003 (NL) ..... 1022595

(51) Int. Cl.
*B41J 2/165* (2006.01)

(52) U.S. Cl. ..... 347/33; 347/23

(58) Field of Classification Search ..... 347/23, 347/33

See application file for complete search history.

(56) References Cited

U.S. PATENT DOCUMENTS 4,371,881 A 2/1983 Bork et al.
5,486,850 A * 1/1996 Nakamura ..... 347/24
5,627,571 A 5/1997 Anderson et al.
6,357,851 B1 * 3/2002 Gaasch ..... 347/33
6,761,428 B2 * 7/2004 Agarwal et al. ..... 347/33
2001/0015734 A1 * 8/2001 Kanda et al. ..... 347/15
2002/0196304 A1 12/2002 Gomez et al.
2005/0088480 A1 * 4/2005 Wouters ..... 347/33

FOREIGN PATENT DOCUMENTS

JP EPO 05-42677 A 2/1993
JP EPO 07-323554 A 12/1995

* cited by examiner

*Primary Examiner*—Manish S. Shah
(74) *Attorney, Agent, or Firm*—Birch, Stewart, Kolasch & Birch, LLP

(57) ABSTRACT

A device for cleaning the nozzles of a printhead of a printer which includes scraper means, recording means for recording which nozzles require cleaning, and a control unit coupled to the recording means for actuating the printhead and/or the scraper means in order to clean the section(s) of the printhead having nozzles(s) requiring cleaning.

21 Claims, 7 Drawing Sheets

CLEANING DEVICE FOR THE PRINTHEAD OF A PRINTER

This non-provisional application claims priority under 35 U.S.C. § 119(a) on Patent Application No. 1022595 filed in The Netherlands on Feb. 5, 2003, which is herein incorporated by reference.

BACKGROUND OF THE INVENTION

1. Field of the Invention

The present invention relates to devices for cleaning the printhead of a printer, particularly, but not exclusively, hot melt printers.

The present invention also relates to a device for bringing a scraper means of a cleaning device into and out of contact with the printhead of a printer for cleaning the printhead.

2. Related Art

Various devices are known for cleaning printheads of printers. Cleaning may be necessary, for example, if nozzles of the printhead are clogged by dried hot melt ink or dirt, if ink or dirt has collected around the nozzles on the surface of the printhead or if air bubbles have formed in the nozzles. To clean the printhead, for example, use can be made of brushes which are stationary in a cleaning unit disposed next to the passageway for the paper path, through which cleaning unit a carriage with the printhead can move. These brushes are situated beneath the extended path of the printhead and the printhead is moved thereover.

Another arrangement is that for a printhead of a hot melt printer provided with an elongate row of nozzles, wherein the row of nozzles are situated transversely of the direction of movement of the printhead. To brush the printhead, use is made of brushes which are heated in order to keep the ink on the printhead fluid when in contact therewith so that the ink can be discharged. The brushes are moved along and over the printhead in the longitudinal direction of the row of nozzles, and hence parallel to the direction of transport. The brushes are heated by the fact that they are situated in an aluminium container which is heated.

The disadvantage of the known cleaning devices is that the printhead is cleaned relatively frequently so that there is considerable wear of the printhead. This is a disadvantage because printheads are expensive. Another disadvantage is that the cleaning device brushes are also subjected to considerable wear. Thus, printer maintenance requirements increase due to the wear and tear of the printhead and/or the brushes.

SUMMARY OF THE INVENTION

It is one object of the present invention to provide an improvement in nozzle maintenance.

For this purpose, the present invention provides a device for cleaning the nozzles of the printhead of a printer, which comprises scraper means, recording means for recording which nozzles require cleaning, and a control unit coupled to the recording means for actuating the printhead and/or the scraper means in order to clean the section(s) of the printhead having nozzle(s) requiring cleaning. Only those sections or that section of the printhead containing the nozzles requiring cleaning are then actually cleaned during a cleaning cycle. The other printhead sections do not come into contact with the scraper means during the cleaning cycle, so that wear on both the printhead and the scraper means is efficiently reduced. The recording means may, for example, comprise piezoelectric elements which record pressure waves in the ducts of the nozzles. Alternatively, the recording means may comprise optical sensors, for example line sensors.

In one embodiment, the scraper means are subdivided into adjacent separate scraper units, each separate scraper unit comprising separate displacing elements in order to clean a corresponding section of the printhead having nozzles requiring cleaning. The separate displacement elements are adapted to be actuated separately by the control unit. If during the cleaning cycle the printhead has a known fixed position, the control of the displacement means can be adapted thereto in a relatively simple manner. Only those (separate) displacement means required to clean the corresponding section(s) of the printhead need to be actuated and only those heads which require cleaning are actually cleaned. Finally, the effect of this is that only a minimum amount of ink is consumed during flushing through with ink.

In a preferred embodiment, the separate displacement elements are arranged for displacement between an operative position in the path of the printhead for cleaning the corresponding section of the printhead, and an inoperative position outside the path of the printhead. The cleaning of a section or sections can then be carried out easily by actuating the corresponding scraper unit or units, by means of the associated displacement means, for displacement into the operative position. The printhead can then be moved along a known trajectory along the scraper unit or units in the operative position, the corresponding section or sections being scraped clean. The scraper units in the inoperative position do not come into contact with the printhead at this time.

Preferably, the inoperative position is a position situated outside the plane of movement of the printhead. Preferably, the displacement direction of the scraper units perpendicular to the plane in which the nozzle openings are situated is advantageously mainly vertical. The scraper unit can also be moved along a stationary head. Advantageously, the separate scraper units are formed by separate holders with brushes received therein. Brushes are formed by one or more strips of elastomeric material.

In one embodiment, the printer is a hot melt printer and the separate holders are separately heatable by the actuation of heating elements, by the control unit. Only that holder or those holders whose brush must perform the cleaning operation are then heated, so that the brushes received in the holders are also heated by thermal conduction with the holder or holders in order to keep the hot melt printer ink in a liquid state during scraping along the printhead so that the ink can be discharged. The selective heating of the holder or holders results in an energy saving. Preferably, the heating means are adapted to heat the holders to the ink melting temperature, preferably to about 125° C. The holders are advantageously made of metal, preferably aluminium.

In one preferred embodiment, the separate displacement elements connected to the separate scraper units comprise separate pieces of bimetal. Heating of a separate bimetal piece results in the deformation thereof. Thus, by the correct dimensioning and choice of the bimetal and heating thereof to a specific temperature, a required deformation of the piece then occurs, with the required displacement of the scraper unit connected thereto. The construction thus becomes simple, requires little maintenance, and is reliable.

Advantageously, the heating means form part of the displacement means so that by the heating of the separate holders by heat conduction between the respective holders and the corresponding bimetal pieces, the latter are deformed. The heating means then have two functions: in addition to the separate heating of the brushes by heating the corresponding holders, the corresponding bimetal pieces are also heated in order to obtain the required displacement of the holders connected thereto. Another simplification of the construction is thus obtained.

Preferably, the separate bimetal piece is a hollow cup-shaped laminate. Upon heating to a specific temperature the cup will then flip over, from a convex shape to a concave shape or vice versa. As a result of this flipping over, the displacement is obtained between the inoperative position of the scraper means and the operative position. Upon cooling of the cup, it will flip back so that the displacement is obtained between the operative position and the inoperative position.

Advantageously, each separate cup-shaped bimetal piece is rigidly fixed to two or more support arms which are themselves hingeably fixed on a supporting device therefor. Since the support arms at the location of the rigid fixing points on the separate cup-shaped bimetal piece will assume the same shape there as the separate cup-shaped bimetal piece, the orientation of the support arms will also change there with the shape of the bimetal during the flipping over of the cup. The support arms, as it were, flip over together with the cup-shaped bimetal piece. As a result, the bridged distance of the scraper means during the flipping over of the cup-shaped bimetal piece and of the support arms will be increased so that a sufficiently large intermediate distance is achieved between the operative position and the inoperative position.

The present invention also relates to a cleaning device for cleaning the nozzles of a printhead of a printer, comprising a scraper element for the printhead, a control unit for actuating the displacement elements to displace the scraper means between an operative position in the path of the printhead for cleaning the latter, and an inoperative position outside the path of the printhead, wherein the displacement element comprises a bimetal element connected to the scraper means and heating means. The transition from the inoperative position to the operative position then takes place by heating, and as a result thereof, deformation of the bimetal element. Compared with displacement systems comprising, for example, a motor or a cam mechanism, the present construction is simple, requires low maintenance and is reliable.

In one preferred embodiment, the printer is a hot metal printer in which the heating means are adapted also to heat the scraper means. The heating means then has two functions: in addition to heating the bimetal element, also heating the scraper element so that during scraping along the printhead the hot melt printer ink is made liquid so that it can be scraped off. Preferably, the scraper element comprises a holder with at least one brush received therein, the holder preferably being of metal, preferably aluminium. Advantageously, the heating means are adapted to heat the holder to the ink melting temperature, preferably to about 125° C.

Preferably, the cleaning device is also provided with means for determining which nozzles or group of nozzles require cleaning, wherein the control means are adapted to actuate the displacement element in dependence on the detection means in order to bring the cleaning means into the operative position for the nozzles or group of nozzles selected by the detecting means.

The invention also relates to a printer provided with a cleaning device having one or more of the characteristic features described hereinabove.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1A:
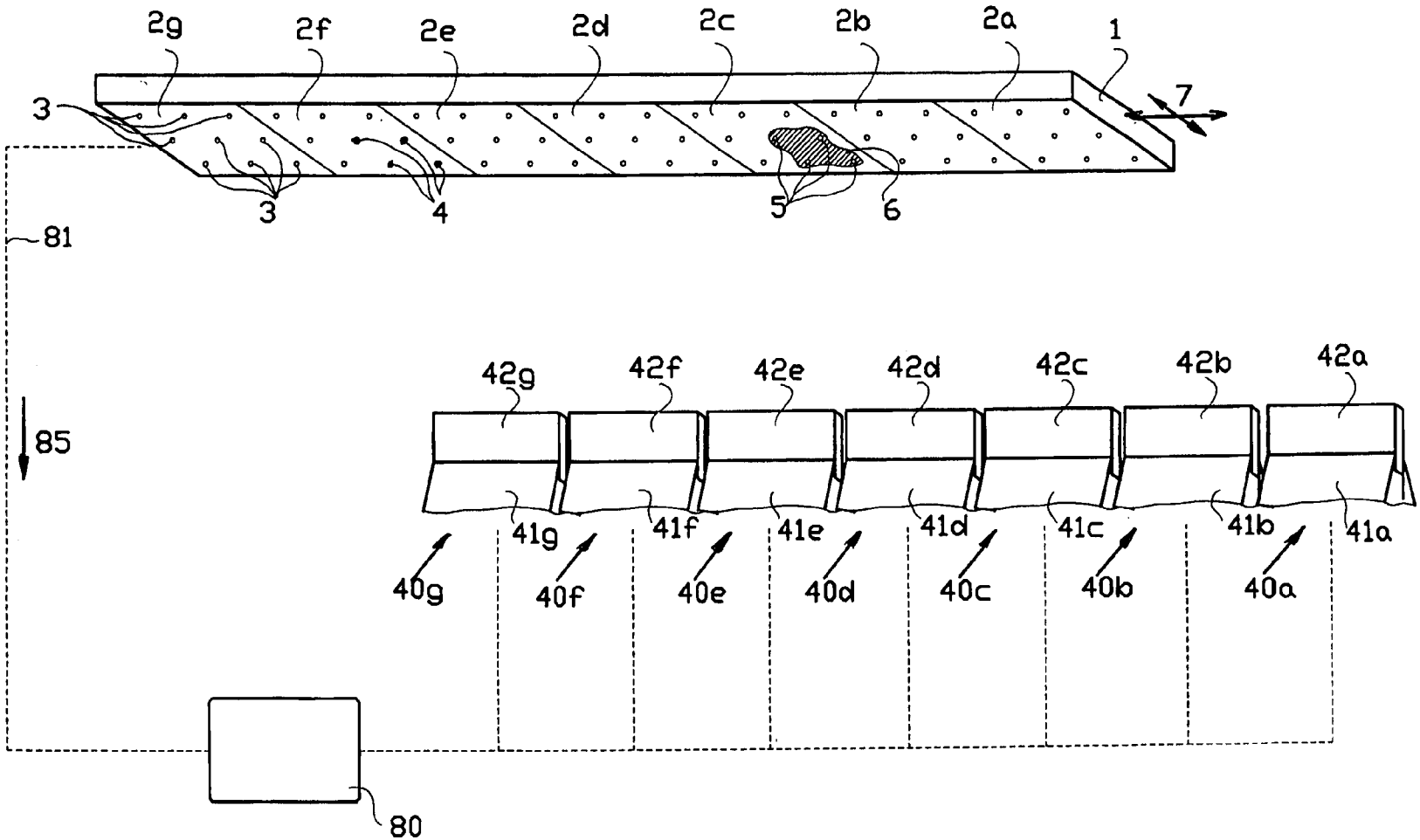
FIGS. 1A to 1E are perspective views of one exemplified embodiment of a cleaning device for the selective cleaning of nozzles of a printhead of a hot melt printer and the process steps for performing the selective cleaning.

In the arrangement shown in FIG. 1A, which forms part of a hot melt printer, there are shown a printhead 1 with nozzles 3, a number of scraper units 40*a-g* each having a brush 42*a-g* of elastomeric material, and a control unit 80 operatively connected to the printhead 1 and the scraper units 40*a-g*. The arrangement illustrated is shown in a starting position. The printhead 1 is (imaginarily) subdivided into different selectively cleanable sections 2*a-g*, each of the sections 2*a-g* comprising a number of nozzles 3. For reasons of clarity, only a few nozzles 3 are shown on a highly enlarged scale for each of the sections 2*a-g*. Section 2*f* contains a number of clogged nozzles 4 and section 2*c* contains a number of nozzles 5 around which dirt 6 has collected; the nozzles 4, and 5 are the nozzles requiring cleaning.

The printhead 1 is also provided with recording means (not shown in FIGS. 1A-E) for recording which nozzles 3 require cleaning. The recording means comprise, for example, piezoelectric elements which record pressure waves in the ducts of the nozzles 3. The recording means are operatively connected to the control unit 80 by connection 81, in order to transmit to the control unit 80 information relating to which nozzles require cleaning in the printhead 1, and in this case therefore nozzles 4 and 5.

The printhead 1 has a plane of movement 7 which in the starting position illustrated so extends that there is no possible operative contact between the brushes 42*a-g* and the printhead 1. On movement in the plane 7, the printhead 1 moves over the brushes 42*a-g* without coming into contact therewith. For movement in the plane 7 the printhead 1 is provided with drive and guide means (not shown). The drive means of the printhead 1 are controlled by the control unit 80.

The scraper units 40*a-g*, of which only the top surfaces are shown in FIGS. 1A-E, respectively comprise metal (aluminium) holders 41*a*-41*g*, in which the respective brushes 42*a*-42*g* are clamped. Each of the scraper units 40*a*-40*g* is separately controllable by the control unit 80 for displacement perpendicularly to the plane of movement 7 of the printhead 1 from an inoperative position to an operative position and vice-versa. In the inoperative position, on movement of the printhead 1 in the plane of movement 7, no contact is possible between the relevant brush 42*a-g* and the printhead 1. The relevant brush 42*a-g* is situated at some distance above the printhead 1. In the operative position, on movement of the printhead 1 in the plane of movement 7, contact is possible between the relevant brush 42*a-g* and the printhead 1, the relevant brush 42*a-g* can then scrape along the associated section 2*a-g* in order to clean it.

To enable the cleaning operation to be performed, each of the holders 41*a-g* is provided with a respective heating element shown in detail in FIG. 2, which is separately actuatable by the control unit 80. Thus by thermal conductivity between the heating element, the respective holder 41*a-g* and the respective brush 42*a-g*, each heating element can heat the latter. When the brush 42*a-g* has thus acquired a sufficiently high temperature, it can keep the ink on the associated section 2*a-g* liquid when in the operative position and in contact with the associated section 2*a-g*, in order to discharge the ink from the printhead 1. The ink used for the hot melt printer will remain liquid at a temperature of about 100° C. The holders 41*a-g* are separately heatable to about 125° C. by the heating means.

In the starting position shown in FIG. 1A, none of the scraper units 40*a-g* has been brought into the operative position by the control unit 80, and all the brushes 42*a-g* are in the inoperative position. Via connection 81 the recording means indicates to the control unit 80, as shown by arrow 85, that nozzles 4, 5 require cleaning.

Figure 1B:
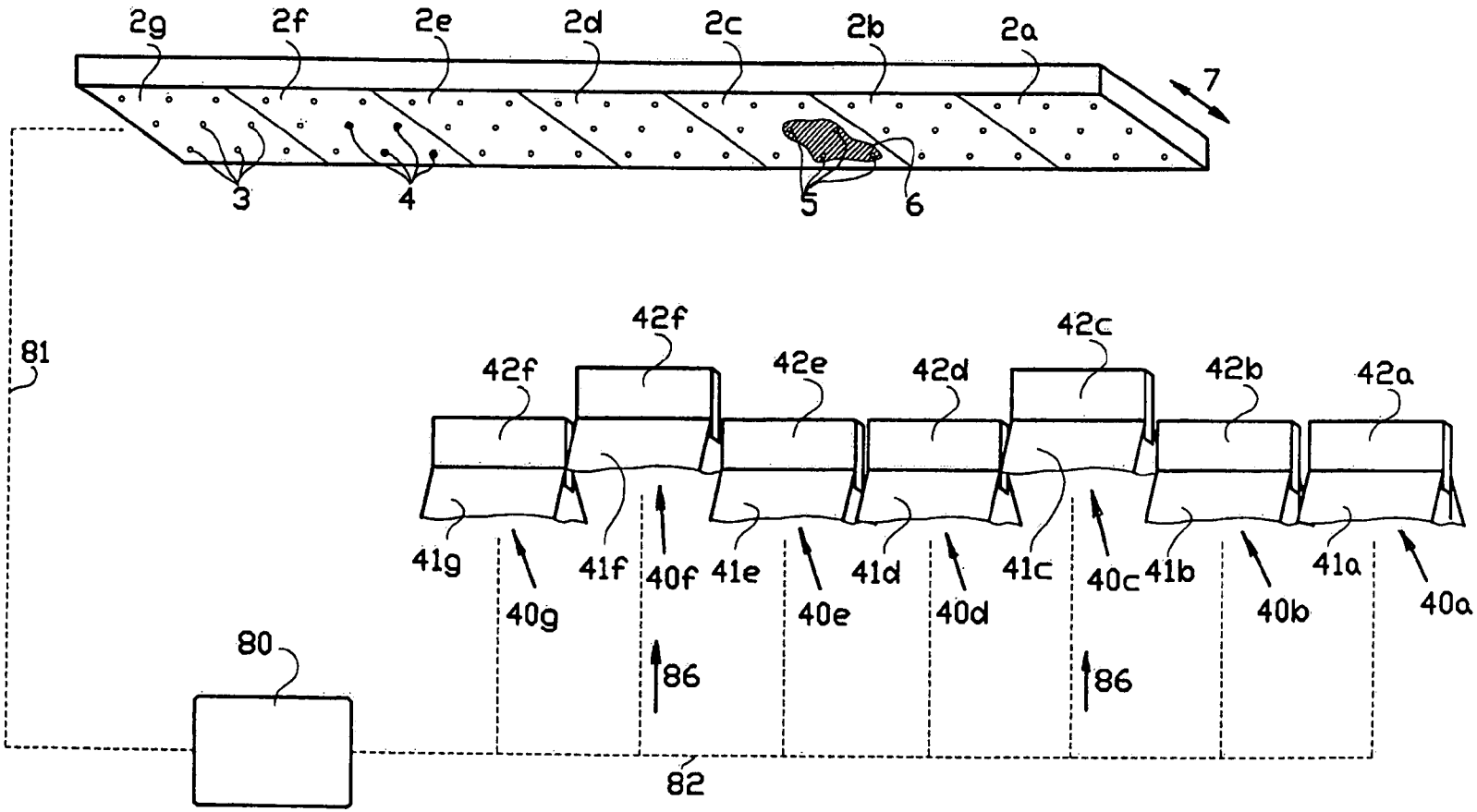

FIG. 1B shows the next step in the process: control unit 80 actuates the corresponding scraper units 40*c* and 40*f* by means of connection 82 as shown by the arrows 86. As a result, the scraper units 40*c* and 40*f* will be moved from the inoperative position to the operative position, the holders 41*c* and 41*f* are heated by their respective heating elements and the brushes 42*c* and 42*f* are also heated by thermal conduction. The scraper units 40*c* and 40*f* are now ready to perform their cleaning operation when printhead 1 is moved over the scraper unit 40 relatively thereto in the plane of movement 7.

Figure 1C:
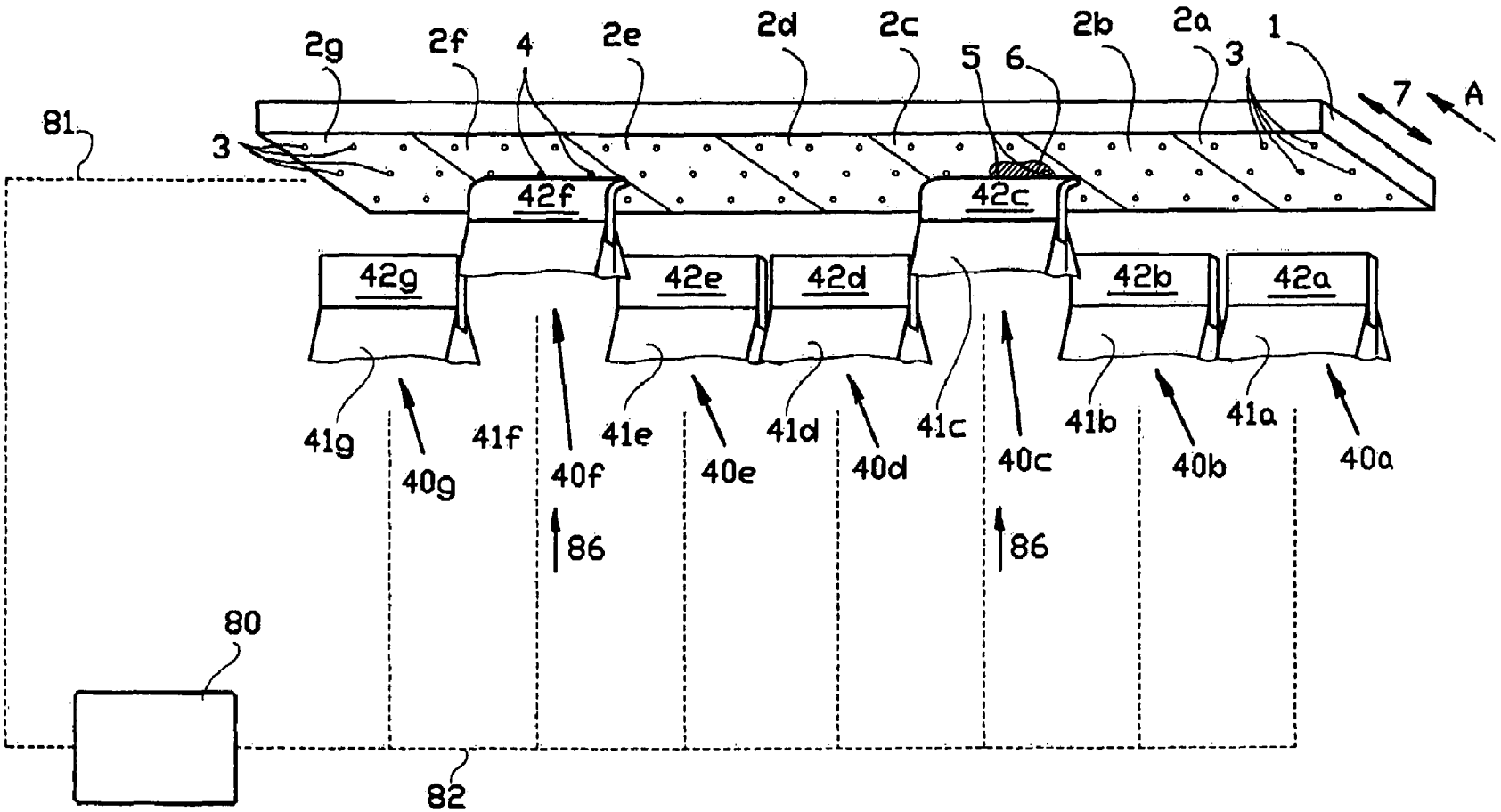

FIG. 1C shows how the printhead 1 is moved over the scraper units 40*a*-40*g* in the direction A by actuation of the control unit 80 of the drive means of the printhead 1. Brush 42*c* is in cleaning contact with section 2*c* in order to remove the dirt 6 around the nozzles 5, and brush 42*f* is in cleaning contact with section 2*f* in order to scrape the nozzles 4 clean. The movement over the scraper units 40*a-g* takes place over the entire (or substantially entire) width of the printhead 1 so that the sections 2*c* and 2*f* are scraped clean over their entire (or substantially entire) surface.

Figure 1D:
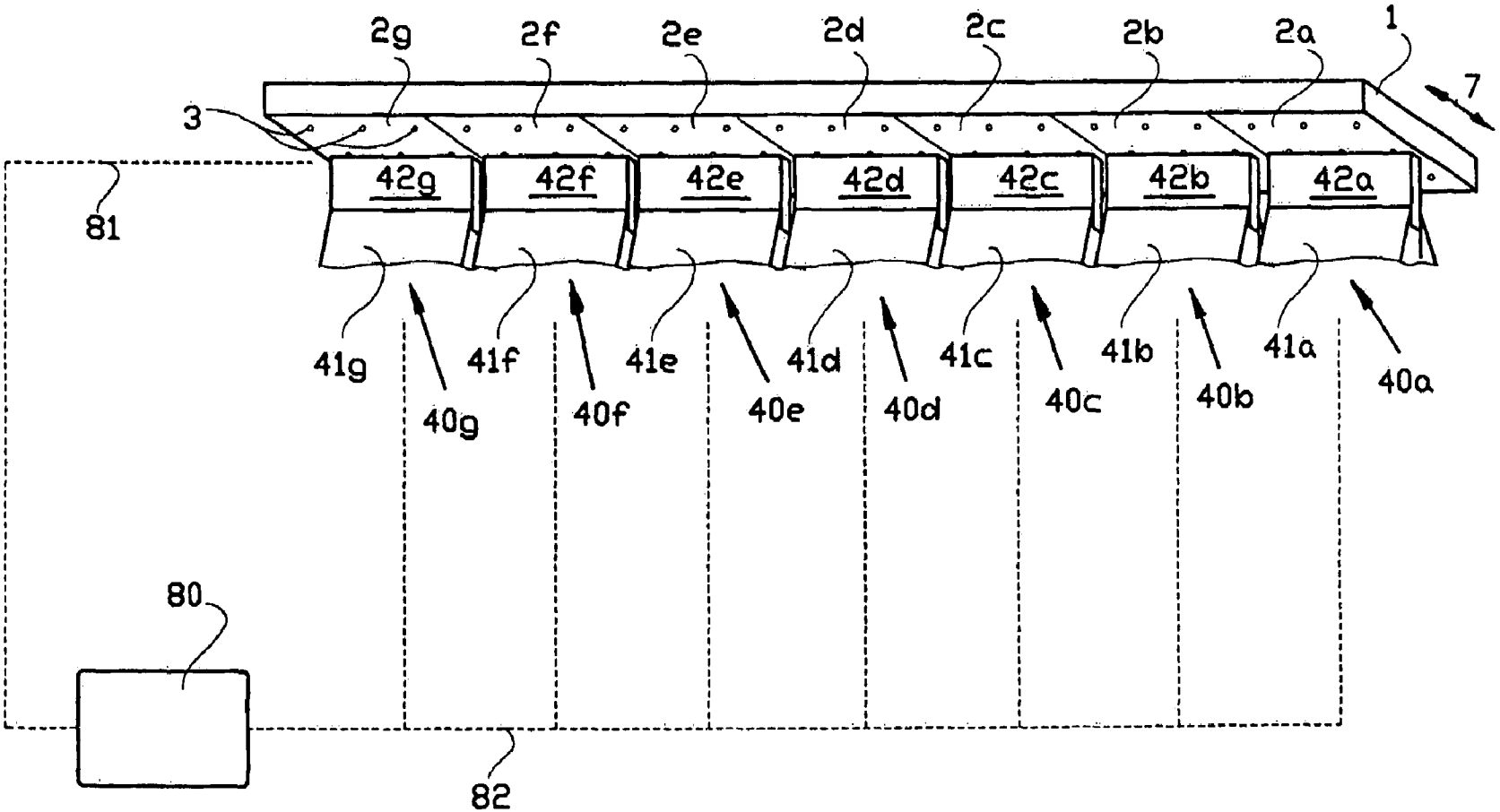

FIG. 1D shows the situation after the completion of the cleaning shown in FIG. 1C. The nozzles 4 have been scraped clean and the dirt 6 around the nozzles 5 has been removed. Actuation of the scraper units 40*c* and 40*f* by the control unit 80 has ceased. As a result, the scraper units 40*c* and 40*f* have returned to their inoperative position and the heating of the holders 41*c* and 41*f* has ceased. The printhead 1 can be situated on the other side of the scraper units 40*a-g* than that shown in FIGS. 1A and 1B.

Figure 1E:
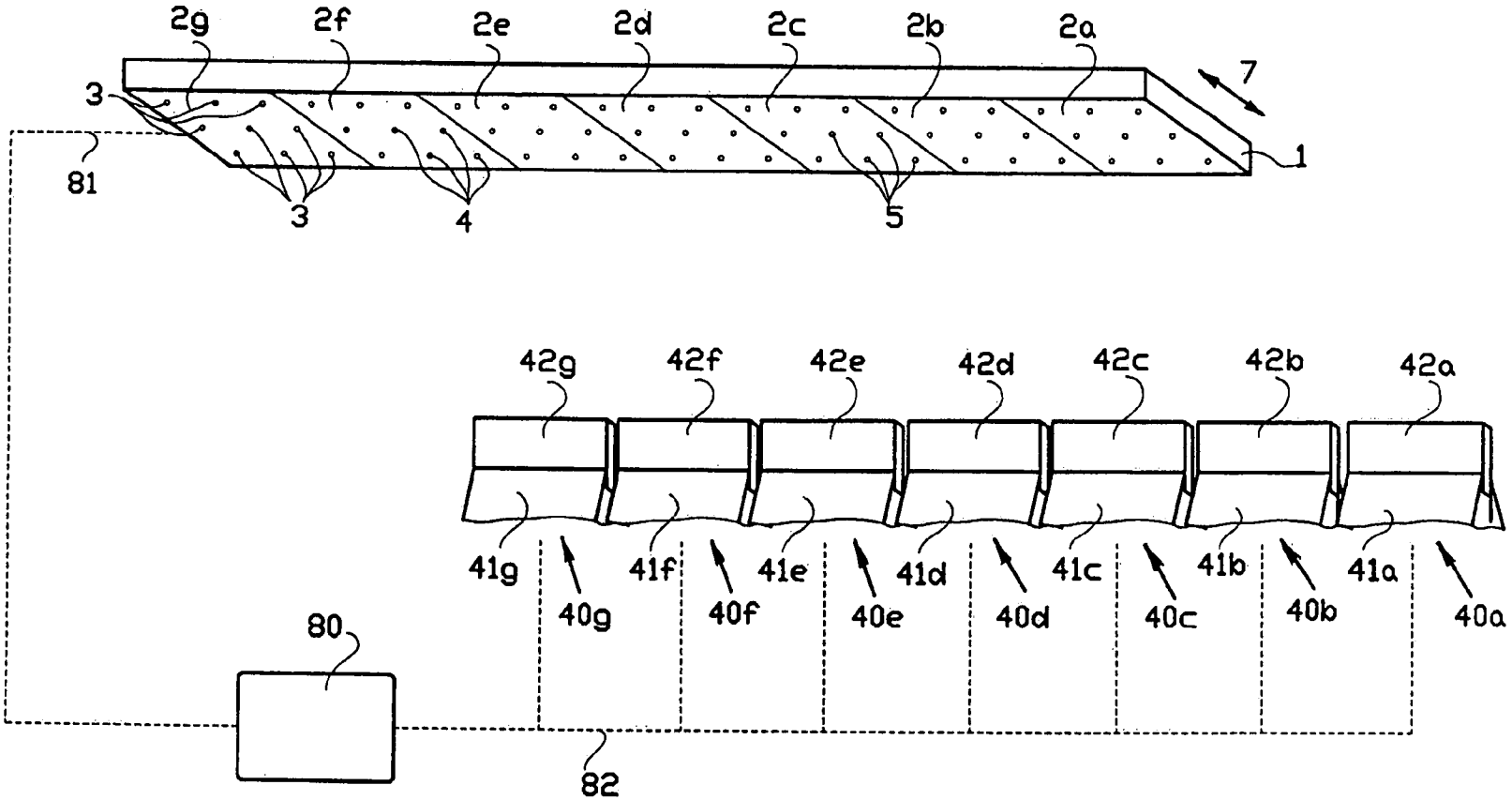

FIG. 1E finally shows the situation in which the printhead 1 has been moved back to the starting position of FIG. 1A from the situation shown in FIG. 1D by actuation by the control unit 80 of the drive means.

With the above-described cleaning device and cleaning process, wear of both the printhead 1 and of the brushes 42*a*-42*g* is restricted to the minimum.

Figure 2B:
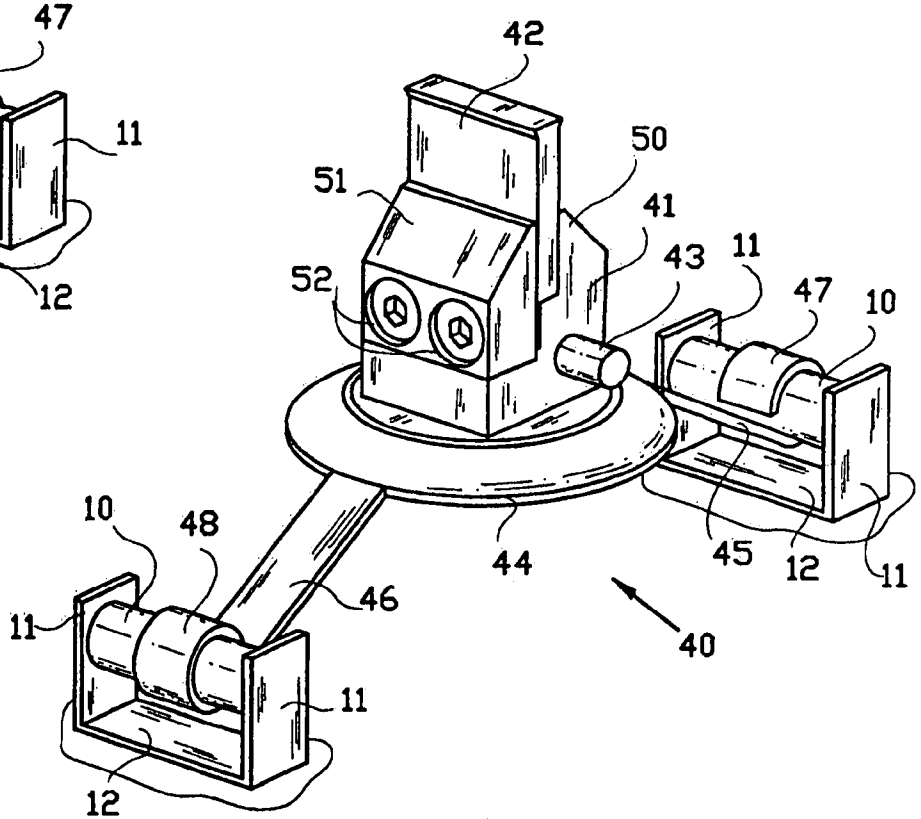
FIGS. 2A and 2B are perspective views in greater detail, more completely showing a separate scraper unit as used in the cleaning device illustrated in FIGS. 1A-E, in respectively, a withdrawn, unheated and an operative, heated condition.
Figure 2A:
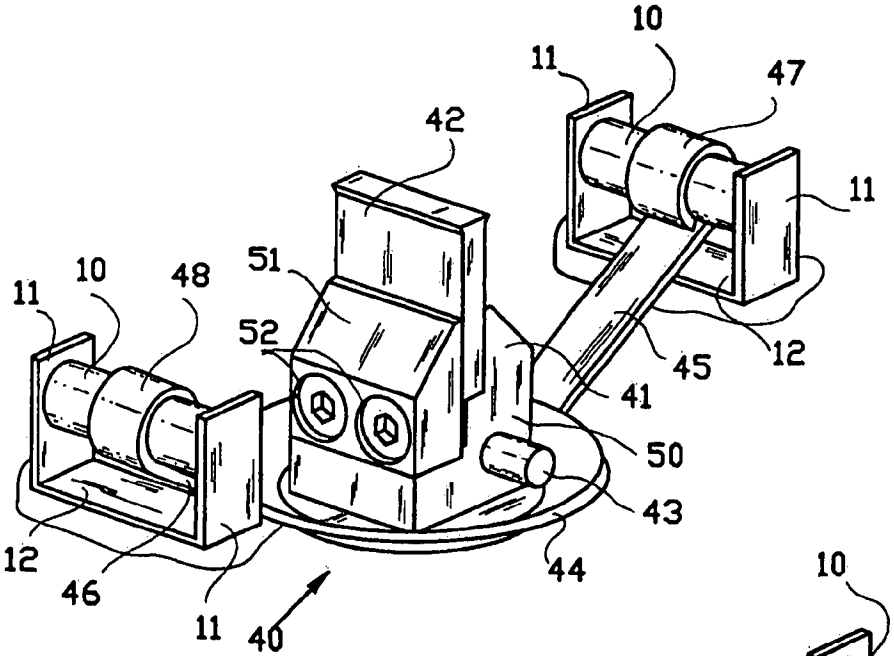

The separate scraper unit 40, as shown partially in FIGS. 1A-E, is shown in greater detail and more completely in FIGS. 2A and 2B. The scraper unit 40 comprises a brush 42, a holder 41, a heating element 43 connected to a supply actuatable by control unit 80, and a bimetal (laminated) cup 44 rigidly connected to two arms 45, 46 with respective ends 47, 48. The ends 47, 48 are adapted to hinge about pins 10 which are fixed in uprights 11 firmly fixed to a base 12 in the printer, so that the scraper unit 40 is fixed separately and hingeably to the printer frame. The holder 41 is made up of two parts 50 and 51 which can be screwed together by screws 52 to clamp the brush 42. The heating element 43 can heat the holder 41, the brush 42 and the bimetal cup 44 by thermal conduction. The effect of heating the brush 42 has already been discussed in connection with FIG. 1.

As shown in FIG. 2B, as a result of heating the bimetal cup 44 to a specific temperature by the heating element 43, the bimetal cup 44 flips over. Since the arms 45, 46 are rigidly connected to the bimetal cup 44, they will follow the orientation of the latter during the flipping over; the arms 45, 46 also flip over, this being facilitated because the ends 47, 48 are locally hingeably connected in pins 10 to the printer frame. The movement of the scraper unit 40 from the inoperative position to the operative position is obtained as a result of the joint flipping over of the bimetal cup 44 and the arms 45, 46 connected thereto. When the system shown in FIG. 2B cools, the bimetal cup 44 and the arms 45, 46 will flip back so that the scraper unit 40 returns from the operative position to the inoperative position shown in FIG. 2A. This is obtained by switching off the heating element 43.

The heating element 43 is the actual element which is actuated, separately for each scraper unit 40, by the control unit 80 shown in FIGS. 1A-E. By activation of the heating element 43, both the required heating of the brush 42 is caused and the required movement of the scraper unit 40 from the inoperative position to the operative position. Motors with gearwheels or similar means for moving the scraper units 40 are superfluous as a result. The system with the bimetal cup 44 is reliable, operationally safe and requires little maintenance.

Figure 3:
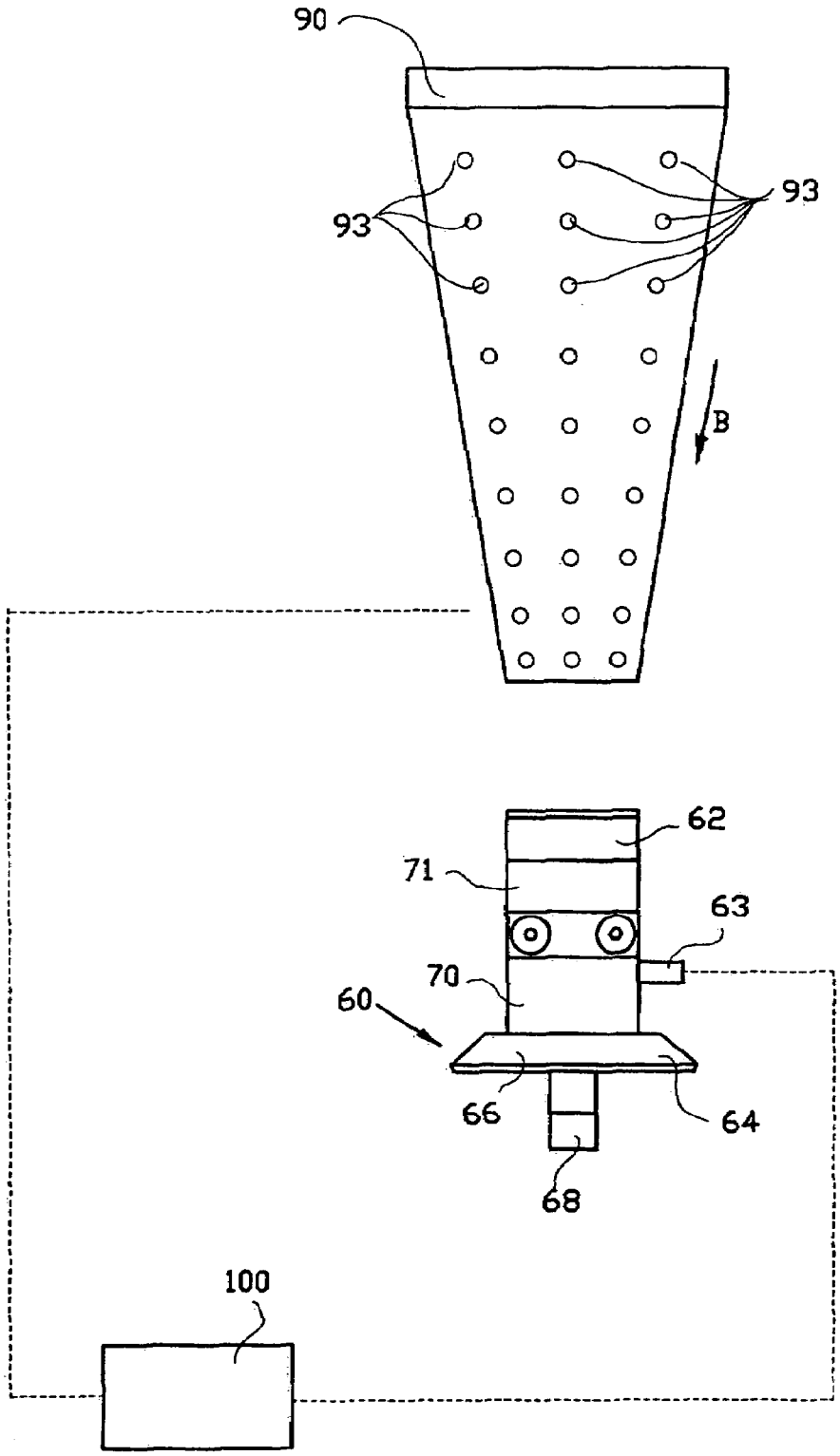
FIG. 3 is a perspective view of a cleaning device with scraper means for the non-selective cleaning of the nozzles of a printhead of a hot melt printer, wherein the scraper means are displaceable by a bimetal element between an inoperative position and an operative position.

FIG. 3 shows an arrangement for the non-selective cleaning of the nozzles 93 of a printhead 90 of a hot melt printer with a scraper unit 60, the latter being movable by means of a bimetal cup 44 between an inoperative position and an operative position. In FIG. 3, the scraper unit 60 is shown in the operative position, and when the brush 62 moves over the printhead 90 it will come into contact with the nozzle surface of the printhead 90. In the position shown in FIG. 3, the scraper unit 60 is situated past the top end of printhead 90. The scraper unit 60 is the only scraper unit of the cleaning device and is coupled to a control unit 100. The drive (not shown) of the printhead 90 is also coupled to the control unit 100. Here again, for the sake of clarity, only a few nozzles 93 of the printhead 90 are shown on a highly enlarged scale. The construction and operation of the scraper unit 60 is identical to that shown and described in connection with FIGS. 2A and 2B, but in this case no selective cleaning of sections of the printhead 90 is applied. The entire nozzle surface of the printhead 90 is cleaned in one operation by scraping it along the scraper unit 60 in the longitudinal direction B. It will be apparent that the movements as described of the heads and scraper unit are relative to one another.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for cleaning the nozzles of a printhead of a printer wherein the nozzles are arranged in at least one row extending in a longitudinal direction, the longitudinal direction being transverse to a scanning direction which comprises:

scraper means;

recording means for recording which nozzles require cleaning; and a control unit coupled to the recording means for actuating the printhead and/or the scraper means in order to clean section(s) of the printhead having nozzle(s) which require cleaning, wherein the scraper means is subdivided in the longitudinal direction into a plurality of adjacent separate scraper units, each separate scraper unit comprising separate displacing means in order to clean a corresponding longitudinal section of the printhead having nozzles requiring cleaning, and wherein the separate displacement means are adapted to be actuated separately by the control unit.

2. The cleaning device according to claim 1, wherein the separate displacement means are arranged for displacement between an operative position in the path of the printhead for cleaning the corresponding section of the printhead, and an inoperative position outside the path of the printhead.

3. The cleaning device according to claim 2, wherein the inoperative position is a position situated outside the plane of movement of the printhead.

4. The cleaning device according to claim 3, wherein the displacement direction of the scraper units perpendicular to the plane in which the nozzle openings are situated is mainly vertical.

5. The cleaning device according to claim 1, wherein the separate scraper units are formed by separate holders with brushes received therein.

6. The cleaning device according to claim 5, wherein the printer is a hot melt printer and the separate holders are separately heatable by the actuation of heating means controlled by the control unit.

7. The cleaning device according to claim 6, wherein the heating means are adapted to heat the holders to above the melting temperature of the ink, preferably to about 125° C.

8. The cleaning device according to claim 6, wherein the heating means form part of the displacement means so that by the heating of the separate holders, by heat conduction between the respective holders and the corresponding strips of bimetal, the latter are deformed.

9. The cleaning device according to claim 5, wherein the holders are made of a metal, preferably aluminum.

10. The cleaning device according to claim 1, wherein the separate displacement means connected to the separate scraper units comprise separate bimetal pieces.

11. The cleaning device according to claim 10, wherein the separate bimetal piece is cup-shaped.

12. The cleaning device according to claim 11, wherein each separate cup-shaped bimetal is rigidly fixed to two or more supporting arms which are themselves hingeably fixed to a support device therefor.

13. An inkjet printer provided with the cleaning device of claim 1.

14. The cleaning device of claim 1, wherein, in the inoperative position, the plurality of adjacent, separate scraper units are aligned in the same planes as a sample unit.

15. A cleaning device for cleaning the nozzles of a printhead of a printer, comprising:

scraper means for the printhead, a displacement means;

a control unit for actuating the displacement means to displace the scraper means between an operative position in the path of the printhead for cleaning the latter, and an inoperative position outside the path of the printhead, wherein the displacement means comprises;

a bimetal element connected to the scraper means; and heating means for heating the bimetal element, which, in turn, causes the scraper means to move from an inoperative position to an operative position.

16. The cleaning device according to claim 15, wherein the printer is a hot melt printer in which the heating means are adapted also to heat the scraper means.

17. The cleaning device according to 16, wherein the scraper means comprise a holder with at least one brush received therein.

18. The cleaning device according to claim 17, wherein the holder is of metal, preferably aluminum.

19. The cleaning device according to claim 18, wherein the heating means are adapted to heat the holder to the ink melting temperature, preferably to about 125° C.

20. The cleaning device according to claim 15, further containing means for detecting which nozzles or group of nozzles require cleaning, wherein the control means are adapted to actuate the displacement means in dependence on the detection means in order to bring the cleaning means into the operative position for the nozzles or group of nozzles selected by the detecting means.

21. The cleaning device of claim 15, wherein the scraper means comprises a plurality of scraper units and the control unit separately activates the heating means for each scraper unit.

* * * * *